United States Patent [19]

Bailey et al.

[11] 4,037,570

[45] July 26, 1977

[54] STRATIFIED CHARGE INTERNAL COMBUSTION ENGINE

[76] Inventors: Henry E. Bailey, P.O. Box 749, Orinda, Calif. 94563; Dennis H. Bailey, Rte. 1, Box 45, Clear Lake, Calif. 95457; Richard E. Bailey, P.O. Box 6327, Clearlake Highlands, Calif. 95422

[21] Appl. No.: 656,306

[22] Filed: Feb. 9, 1976

[51] Int. Cl.[2] ..... F01L 11/00

[52] U.S. Cl. ..... 123/47 A; 123/47 R; 123/75 B; 123/75 CC

[58] Field of Search ..... 123/75 RC, 75 CC, 75 B, 123/37, 22, 47 R, 47 A

[56] References Cited

U.S. PATENT DOCUMENTS

| | | | |
|---|---|---|---|
| 349,983 | 9/1886 | Daimler | 123/75 CC |
| 541,773 | 6/1895 | Mead | 123/47 R |
| 581,412 | 4/1897 | Capitaine | 123/47 A |
| 864,586 | 8/1907 | Wottring | 123/47 R |
| 1,077,150 | 10/1913 | McCornack | 123/47 A |
| 1,281,196 | 10/1918 | Norrbom | 123/75 RC |
| 1,606,479 | 11/1926 | Midgley | 123/75 RC |
| 2,082,078 | 6/1937 | Ottoson | 123/47 R |

FOREIGN PATENT DOCUMENTS

| | | | |
|---|---|---|---|
| 1,078,641 | 11/1954 | France | 123/47 A |

*Primary Examiner*—Ronald H. Lazarus
*Assistant Examiner*—David D. Reynolds
*Attorney, Agent, or Firm*—Flehr, Hohbach, Test, Albritton & Herbert

[57] ABSTRACT

A four stroke cycle internal combustion engine is disclosed with means to provide auxillary pumping of air directly into the cylinder. The piston head is provided with a sliding valve which is self-acting for injecting air into the cylinder during the intake stroke, and to inject air into the cylinder during a portion of the expansion stroke. An air pumping chamber is formed between the lower portion of the piston and the cylinder carries a self-acting sliding valve which controls the flow of air into the pumping chamber.

4 Claims, 14 Drawing Figures

STRATIFIED CHARGE INTERNAL COMBUSTION ENGINE

BACKGROUND OF THE INVENTION

Conventional internal combustion engines such as those used in automobiles and trucks have various characteristics which result in relatively low efficiency coupled with unacceptable levels of exhaust emissions. For example, the power delivered by such an engine at any speed is regulated by controlling the amount of air-fuel mixture entering the cylinder, and during all part load operation energy is lost in the process of inducting air through the carburetor past the partially closed throttle. This also decreases the intake manifold pressure below atmospheric, with consequent variation of air-fuel ratios, compression ratios, heat rejection and flame speed.

Moreover, at all engine speeds the charge in the cylinder contains some exhaust gas from the previous cycle left in the combustion chamber. At idle or light load conditions this residue may be as must as one-third of the new charge in the cylinder.

Furthermore, the flame that starts combustion of the air-fuel mixture is quenched close to the relatively cold cylinder wall and as a result contains unburned fuel which is emitted with the exhaust gases during the exhaust stroke. In much the same way the fuel-air mixture is forced along the piston and in back of the top compression ring during the compression stroke. The fuel in this portion of the mixture does not burn during the main combustion process, and during the expansion stroke the fuel escapes and forms a layer of hydrocarbons on the relatively cold cylinder wall. During the exhaust stroke these hydrocarbons are scraped from the cylinder wall and join with the exhaust gases, enough of which survive post-quench oxidation to be a prime source of unburned hydrocarbon emissions.

When a single carburetor feeds a number of cylinders the fuel tends to go preferentially to certain cylinders at the expense of others. The resulting relative spread in the air-fuel ratio going to the various cylinders can be as much as 10–15%. In order for the lean cylinders to receive an ignitable mixture the rich cylinders must receive more fuel than can be efficiently burned. This problem is aggravated by the exhaust gas left in the combustion chamber from the previous cycle, which is substantially the same in volume for each cycle. Thus the ratio of exhaust gas to fuel mixture for the lean cylinders is greater than that for the rich cylinders.

The exhaust temperatures of present automobile engines are not high enough in the exhaust manifold during urban driving to oxidize the quenched hydrocarbons in the exhaust stream for adequate emission control.

In internal combustion engines powered by gasoline, exhaust CO and HC emissions could be reduced by increasing the ratio of air to fuel to the point where more air is present than is required for complete combustion so that the excess air could reduce the CO and HC to carbon dioxide and water. Maximum emissions of $N_x$, however, would occur under such conditions. On the other hand, at any low air-fuel ratios the $N_x$ emissions could be reduced but high concentrations of CO and HC would be produced. Yet at extremely high air-fuel ratios where all three emissions could theoretically be low, the engine could be subjected to stalling and misfiring thereby causing poor performance.

The positive crankcase ventilation system (PCV) which works well on new engines has certain flaws. First, the PCV valve may become clogged with deposits and must be checked and perhaps replaced periodically. Second, when the engine parts are worn the amount of blow-by gases can overwhelm the PCV system, causing throwing of crankcase oil and other problems.

OBJECTS AND SUMMARY OF THE INVENTION

It is a general object of the invention to provide an internal combustion engine which reduces the amounts of harmful exhaust emissions by means of excess air in the combustion process.

Another object is to provide an engine of the type described which will operate with more efficient fuel utilization.

Another object is to eliminate the drop in pressure of the intake manifold when the engine is throttled.

Another object is to provide an engine in which at the end of each cycle the combustion chamber is filled with air instead of exhaust gases.

Another object is to quench the flame of the combustion process into a layer of air instead of into the relatively cold cylinder wall.

Another object is to provide air rather than air-fuel mixture alongside the piston and back of the top compression ring during the compression stroke.

Another object is to provide means for enclosing the air-fuel mixture within the cylinder in an envelope of air.

Another object is to oxidize the quenched hydrocarbons within the cylinder by use of excess air at a time when the ignition temperatures of the cylinder are high.

Another object is to enclose a high fuel-air mixture in the cylinder within an envelope of excess air which when combusted produces a minimum of $N_x$, and as the flame front penetrates the air enclosure the high concentrations of CO and HC products of combustion are reduced to carbon dioxide and water.

Another object is to provide improved means for positive crankcase ventilation and thereby eliminate the need for a PCV valve.

Another object is to provide greater stabilization of the piston action within the cylinder.

In summary the invention includes an engine having a piston with a head of enlarged diameter and with a relatively short depth. A recess is formed in the top center of the piston head to form a seat for a one-way sliding valve which controls air flow from an annular pumping chamber through crenelated channels in the piston head into the combustion chamber. The lower skirt of the piston is of smaller diameter than the piston head.

The upper portion of the cylinder encloses movement of the piston head while a smaller diameter lower cylinder wall encloses movement of the piston skirt. A one-way sliding valve is mounted about the top portion of the lower cylinder wall to control air flow into the pumping chamber from a manifold which is connected either to a separate air cleaner or to the air cleaner supplying the carburetor. A one-way pumping action is thereby produced by reciprocation of the piston to force air into the pumping chamber and thence into the combustion chamber. During the intake stroke the cylinder valve is closed and the piston valve is forced open to direct air into the combustion chamber. During the compression and exhaust strokes the piston valve is closed and the cylinder valve is opened whereby air is drawn into the pumping chamber. During the expansion stroke both valves are closed until the piston valve is open near the end of the combustion phase.

The foregoing and additional objects and features of the invention will become apparent from the following description in which the preferred embodiments have been set forth in detail in conjunction with the accompanying drawings.

DESCRIPTION OF THE PREFERRED EMBODIMENTS

Figure 2:
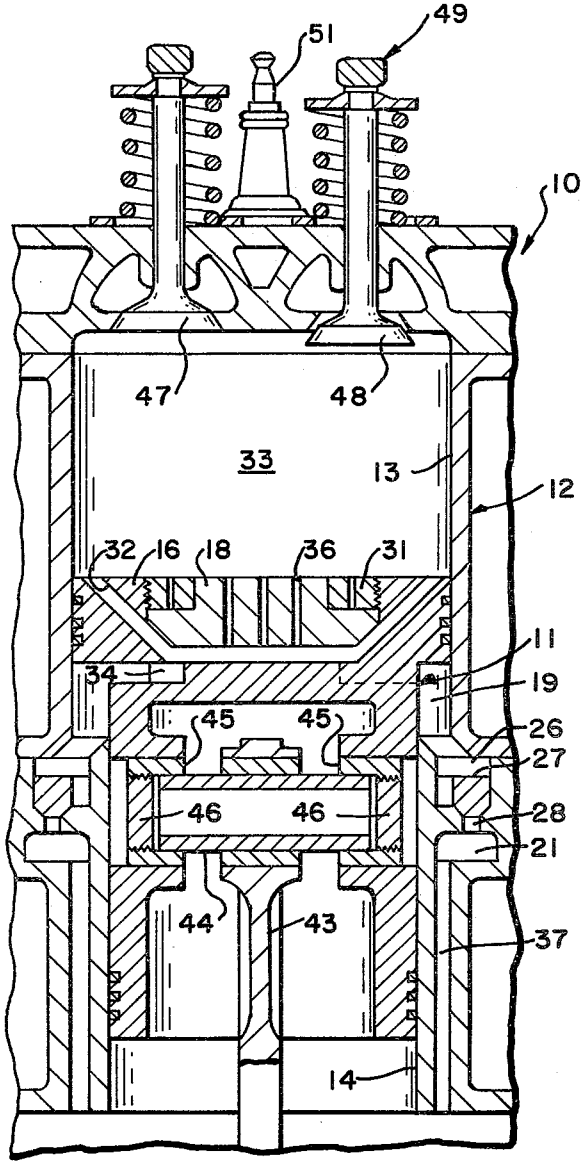
FIG. 2 is an axial sectional view taken along the line 2—2 of FIG. 1 with the piston shown at 90° ATDC of the intake stroke.

In the drawings FIGS. 1–5 illustrate generally at 10 a four stroke cycle internal combustion engine incorporating the invention and including a piston 11 mounted for reciprocation within a cylinder 12. While a single cylinder is illustrated a plurality of the cylinders could be combined in a single block such as with in-line, Vee, flat head or rotary configuration.

Cylinder 12 is divided into an upper cylinder wall 13 and a lower cylinder wall 14. The two cylinder walls are formed in separate cylinder blocks which are secured together by suitable bolts mounted through flanges 15, 15a. Similarly, piston 11 is integrally formed into two sections, an upper piston head 16 and a lower skirt 17. A circular piston valve 18 is mounted on the piston head in a manner to be described, and the outer diameter of the piston head is commensurate with the diameter of upper cylinder wall 13. Similarly, the outer diameter of piston skirt 17 is commensurate with the diameter of lower cylinder wall 14. The diameter of the piston skirt is less than that of the upper cylinder wall so that an annular pumping chamber 19 is formed by the radial spacing between these two walls.

The top of lower cylinder wall 14 is circumscribed by a channel 21 which is connected on one side to an entry channel 22. The entry channel is connected through a manifold 23 and conduit 24 to a suitable air cleaner 25 supplying the main air charge to the engine. Alternatively, a separate air cleaner could be provided for this purpose. Another channel 26 circumscribes the lower end of cylinder wall 12 above channel 21, and an annular cylinder valve 27 is mounted within the channel 26. Vertical channel 28 leads between the channels 21 and 26.

A recess 29 formed in the crown of piston head 16 provides a seat for axial sliding movement of piston valve 18. The valve 18 is captured within recess 29 by means of a retainer ring 31 which can either be rim threaded or permanently attached to the piston head. A series of channels 32 are formed in the piston head about recess 29 and the channels incline downwardly towards the center of the the piston to provide communication between combustion chamber 33 and a series of radial channels 34 which are formed about the piston head below valve 18. The channels 34 are in communication with pumping chamber 19. A plurality of channels 36 are formed vertically through the piston valve from its top face.

In place of the usual PCV valve arrangement a group of vertically extending channels 37 are formed about lower cylinder wall 14 and these channels lead from the top of the crankcase up to the bottom of channel 21.

The bottom of piston skirt 17 is provided with a plurality of piston rings 38. Similarly, a plurality of piston rings 39 are provided about piston head 16. Cooling jacket cavities 41, 42 are formed about the cylinder walls for containing a suitable coolant medium.

A piston rod 43 connected with a crankshaft, not shown, is coupled with the piston through a wrist pin 44 and sleeve bearings 45. A pair of air-tight caps 46 are threadably connected into the opposite ends of sleeve bearings, thereby sealing the wrist pin bore to prevent leakage of air from pumping chamber 19.

Suitable valving mechanism is provided such as the illustrated poppet valves 47, 48 and valve operating mechanism 49 for controlling the flow of intake and exhaust gases into and from combustion chamber 33. The compressed fuel-air mixture is ignited by a spark plug 51 through suitable ignition circuitry.

Figure 1:
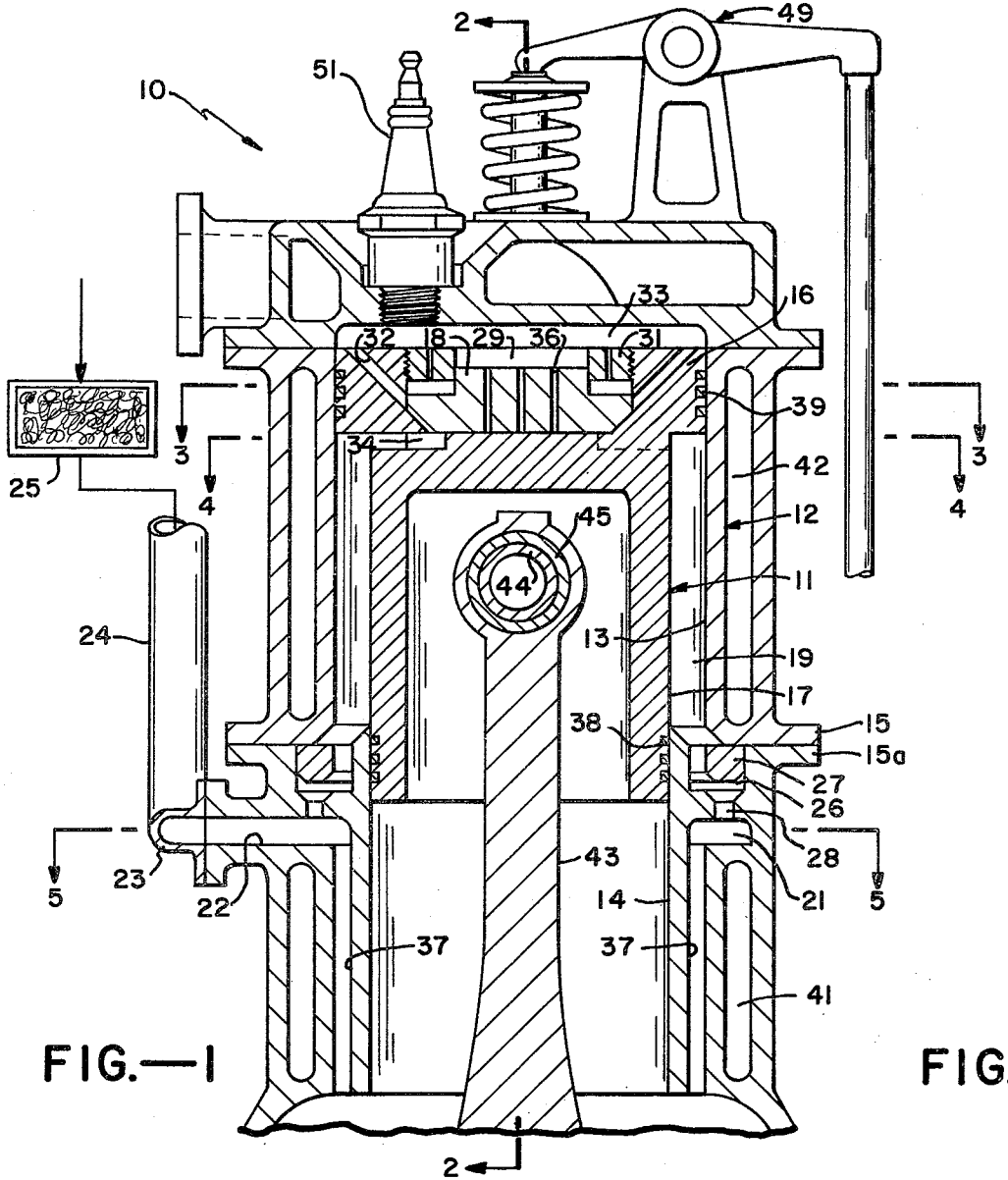
FIG. 1 is an axial section view of one cylinder of a four stroke cycle internal combustion engine incorporating the invention.
Figure 4:
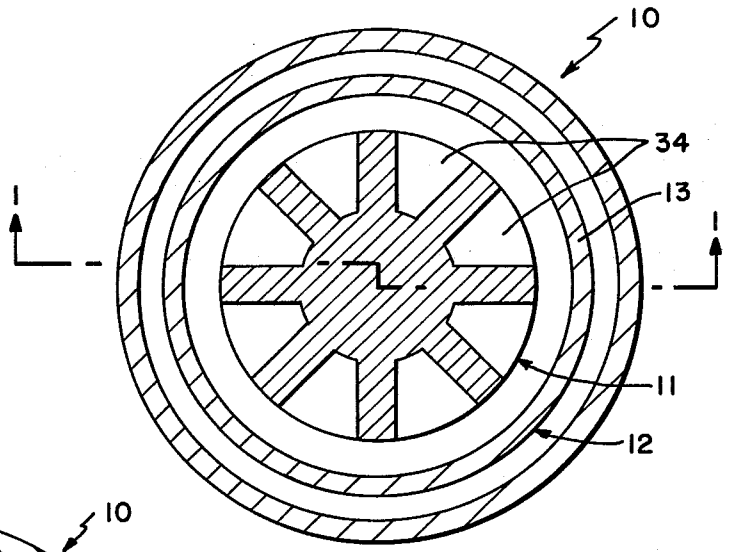
FIG. 4 is a cross sectional view taken along the line 4—4 of FIG. 1.
Figure 3:
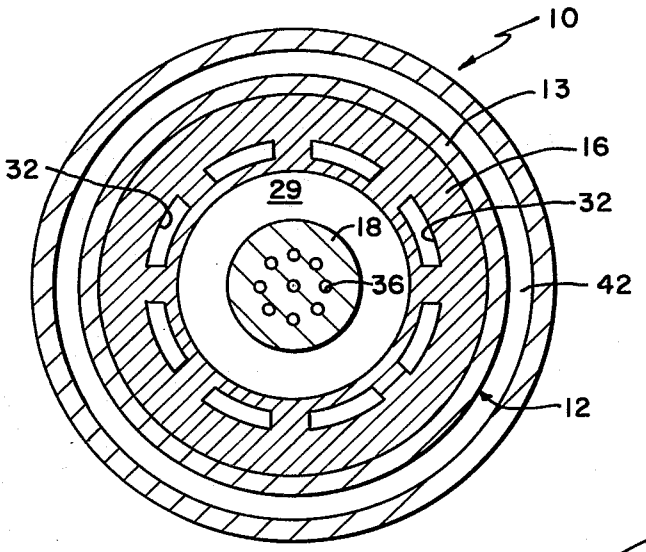
FIG. 3 is a cross sectional view taken along the line 3—3 of FIG. 1.
Figure 5:
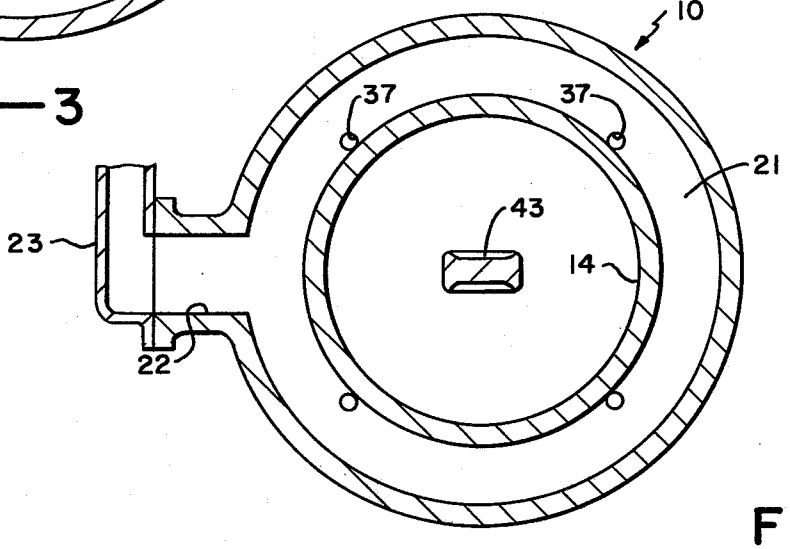
FIG. 5 is a cross sectional view taken along the line 5—5 of FIG. 1.

The operation of the invention will be explained with particular reference to the schematic drawings of FIGS. 6–14 serially illustrating four complete strokes of one cycle of operation. In FIG. 1 a suitable hydrocarbon fuel such as gasoline is atomized with air in a carburetor to form a high or rich fuel-air mixture or combustible charge. The charge is inducted into combustion chamber 33 through the intake valve 47 by the downward movement of piston 11. The downward piston movement tends to compres air within pumping chamber 19 and thereby close cylinder valve 27 and open piston valve 18. Air is thus forced from the pumping chamber through the channels 34 past the open seat of valve 18 and through the piston head channels 32 into and around the walls of the combustion chamber. Some air also flows through the piston valve channels 36 to enter the bottom of the combustion chamber. A stratified charge of rich fuel-air mixture air is thereby formed within the combustion chamber. When the engine is running throttled a drop in pressure normally occurs within the intake manifold. This pressure drop is caused by a partial vacuum created within the combustion chamber, but with the present invention such vacuum is reduced by the injection of air from the pumping chamber.

Figures 6, 7, 8, 9, 10, 11, 12, 13, 14:
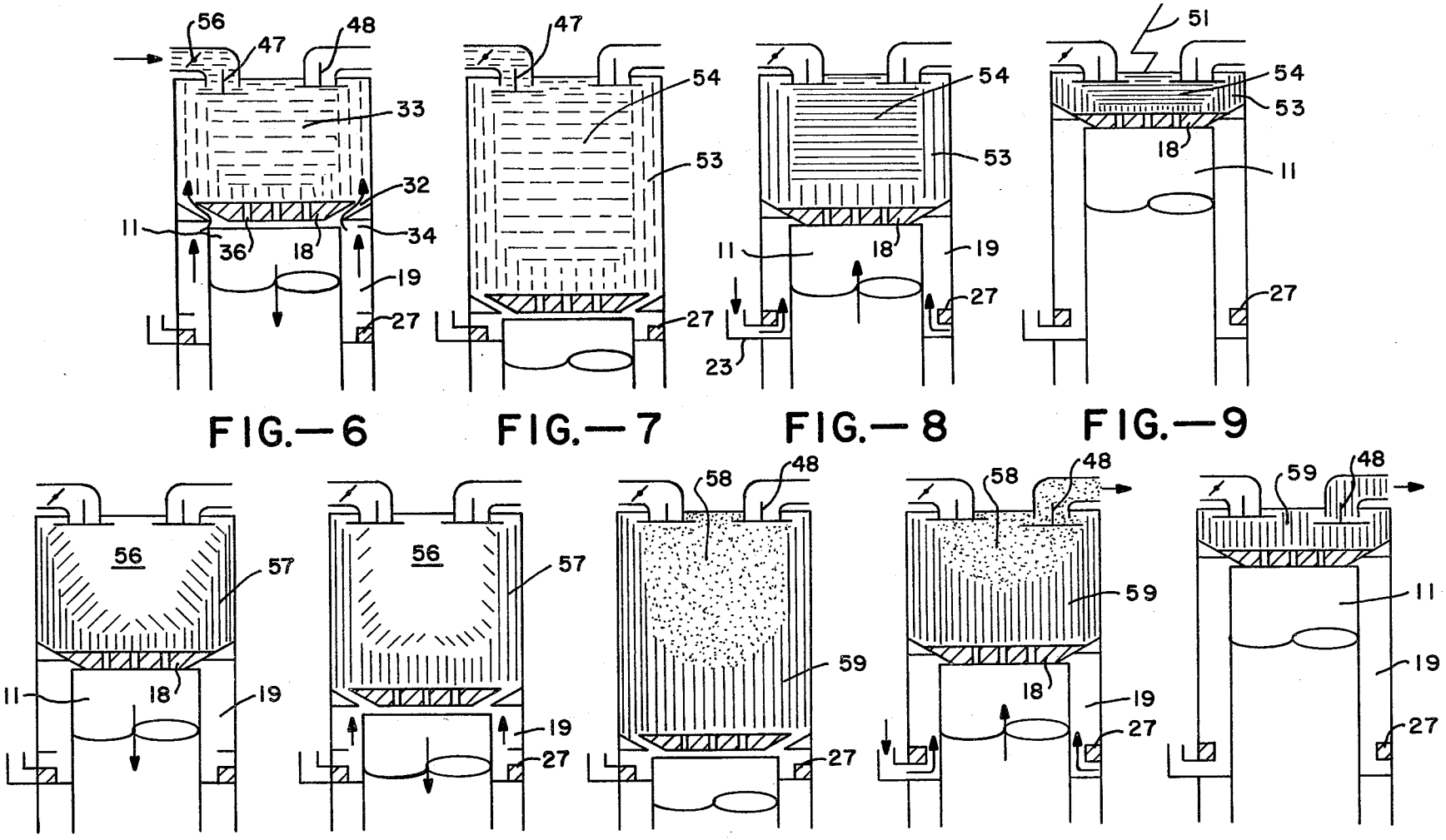
FIGS. 6–14 are a series of schematic drawings showing successive phases of operation of one cycle for the engine of FIG. 1.

The composition of the rich fuel-air mixture and air within the combustion chamber at the end of the intake stroke is depicted in FIG. 7. A layer or cup of injected air 53 is formed within the chamber about the rich fuel-air mixture depicted at 54. A major improvement of the invention is the elimination of pressure drop in the intake manifold when the engine runs throttled. As a result the energy normally consumed in the process of inducting air through the carburetor past the partially closed throttle 56 is used in the cylinder. Likewise, with a partial vacuum eliminated from the combustion chamber the compression ratio at part throttle is maintained at the same ratio as for open throttle, thereby stabilizing the fuel-air ratio of the combustion charge, the flame speed, heat rejection and the charge distribution between cylinders.

During the compression stroke of FIG. 8 pressure within the combustion chamber closes piston valve 18, and the suction due to the bottom face of the piston head acting within the pumping chamber opens cylinder valve 27. Upward piston movement thereby draws air through manifold 23 past the open valve 27 into pumping chamber 19 which is thereby filled with air for the following downward expansion stroke. During the compression stroke the cylinder-lined layer of air 53 substantially remains enveloped about the fuel-air mixture 54.

FIG. 9 illustrates the composition of the fuel-air mixture 54 and air layer 53 at the completion of the compression stroke. An important improved result is that the fuel-air mixture which would normally be forced alongside the piston and behind the top compression ring during the compression stroke is substituted by air, the effects of which will be explained below in regard to the expansion and exhaust strokes.

At the end of the compression stroke the fuel-air mixture is ignited when spark plug 51 is energized. At the onset of the expansion stroke the flame front from the combusting gases 56 (FIG. 10) is surrounded on the bottom and lateral sides by the layer of compressed air 57. As expansion progresses and the piston moves downwardly air pressure builds up within pumping chamber 19 to the point that it is greater than the diminishing pressure of expanding gases within the combustion chamber. The composition of the combustion gases and injected air at this point are depicted in FIG. 11. FIG. 12 depicts the composition of the exhaust gases 58 and air layer 59 at the bottom of the expansion stroke.

Among the improvements from the foregoing are that the relatively rich fuel-air mixture delivered from the carburetor to the combustion chamber is compressed in the chamber surrounded, except at the top, by a layer of compressed air. When ignited the rich fuel-air mixture burns independent of the surrounding air, and with such a mixture flame speed is high and there is a minimum of $N_x$ produced. This process produces high concentrations of CO and HC, but because the flame front penetrates and is quenched by the surrounding layer of air the temperature within the cylinder is high enough to start oxidation of the CO and HC into carbon dioxide and water. This oxidation continues into the following exhaust stroke. No particles of unburned fuel-air mixture emerge from alongside the piston and from in back of the top compression piston ring to adhere to the cylinder wall because of this layer of air. When the injection of air into the cylinder occurs near the close of the expansion stroke the residual hydrocarbons are oxidized and a layer of air remains at the bottom of the combustion chamber. Part of this air layer fills the chamber at the close of the following exhaust stroke.

During the exhaust stroke depicted in FIG. 13 exhaust valve 48 is opened. There is sufficient residual pressure within the combustion chamber to keep piston valve 18 closed, and the suction of the piston head acting within pumping chamber 19 opens cylinder valve 27 to fill this chamber with air for the following intake stroke. The exhaust gases 58 are discharged past the exhaust valve. The temperature of these gases while still within the cylinder is high enough to continue oxidation of any remaining CO and HC, and when exhaust scavenging is complete with the piston at the top dead center position of FIG. 14 the clearance space within the combustion chamber is substantially completely filled with the layer 59 of air without contaminating exhaust gases.

Each time cylinder valve 27 opens during a cycle of operation air enters combustion chamber 33. Not all of this air, however, is drawn from the carburetor air cleaner inasmuch as the suction within pumping chamber 19 also acts upon the channels 37 leading from the top of the crankcase. Accumulations of blow-by gases within the crankcase are thereby drawn upwardly into channel 21 and proceed with the air from manifold 23 into the combustion chamber. This process assumes the presence of the usual fresh air input from the carburetor air cleaner to the crankcase, but at the same time it eliminates the need for the use of a PCV valve.

In addition to ventilating the crankcase the channels 37 also pick up oil mist from action of the crank and piston rods upon the oil reservoir within the crankcase, thereby lubricating the cylinder valve 27 as well as the walls of pumping chamber 19 and piston valve 18.

The piston rings 38 on the bottom of the piston skirt prevents leakage of air from pumping chamber 19 and thereby prevents passage of blow-by gases to the crankcase. These rings also act to produce greater piston stabilization with less friction than can be achieved with the piston skirt contact of conventional engines.

The extent of blow-by gases in the invention is very limited because not only is there the presence of the added piston rings 38 about the piston skirt but the flow of air through the pumping chamber 19 is uni-directional toward the combustion chamber. Any blow-by gases which circumvent the piston rings 38 enter the pumping chamber and are immediately pushed back into the combustion chamber on the return stroke of the piston.

The quantity of atmospheric air infused through pumping chamber 19 into the combustion chamber can be varied according to particular design specification and requirements by varying the diameter of the upper cylinder wall 13 in relation to lower cylinder wall 14.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. In a four-stroke cycle internal combustion engine, means forming at least one cylinder, said cylinder means including an upper cylinder wall having a given diameter and a lower cylinder wall having a diameter less than said given diameter, piston means mounted for reciprocating movement within the cylinder between successive intake, compression, expansion and exhaust strokes, said piston means having a piston head mounted for movement within the upper cylinder wall and defining therewith a combustion chamber together with a piston skirt mounted for movement within the lower cylinder wall, said piston skirt being radially spaced from the upper cylinder to define therewith a pumping chamber, cylinder valve means for directing air into the pumping chamber, intake valve means for directing a fuel-air mixture into the combustion chamber only during the intake stroke, exhaust valve means for directing exhaust gases out of the combustion chamber during the exhaust stroke, piston valve means in the piston means for opening only during a terminal portion of both the intake and expansion stroke for injecting air from the pumping chamber directly into the combustion chamber to form a layer of fresh air below said fuel-air mixture during said intake and compression strokes and to form a layer of fresh air below said exhaust gases during a terminal portion of the expansion stroke and during the exhaust stroke, and means for igniting a compressed combustible mixture within the combustion chamber.

2. An engine as in claim 1 in which the piston valve means comprises a recess in the piston head coaxial therewith, means forming radial channels below the piston head communicating between the pumping chamber and the recess means, and a valve element movable in the recess to open and close said channels responsive to the pressure differential between the combustion chamber and pumping chamber.

3. An engine as in claim 2 which includes means forming channels in the valve element for directing air from the pumping chamber and channels into the combustion chamber co-axially thereof.

4. An engine as in claim 1 in which the piston valve means and cylinder valve means close during the initial portion of the expansion stroke for compressing air within the pumping chamber and also for trapping within the pumping chamber gases which blow by the piston head, and said piston valve means opens while the cylinder valve means closes at the close of the expansion stroke whereby the compressed air and blow-by gases within the pumping chamber are injected through the piston valve means into the combustion chamber.

* * * * *